US012723511B2

(12) United States Patent
Jasu et al.

(10) Patent No.: US 12,723,511 B2
(45) Date of Patent: Sep. 1, 2026

(54) AUTONOMOUS MINING VEHICLE CONTROL

(71) Applicant: SANDVIK MINING AND CONSTRUCTION OY, Tampere (FI)

(72) Inventors: Jari Jasu, Tampere (FI); Lauri Siivonen, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 59 days.

(21) Appl. No.: 18/707,205

(22) PCT Filed: Nov. 1, 2022

(86) PCT No.: PCT/EP2022/080428
§ 371 (c)(1),
(2) Date: May 3, 2024

(87) PCT Pub. No.: WO2023/078866
PCT Pub. Date: May 11, 2023

(65) Prior Publication Data

US 2024/0344459 A1 Oct. 17, 2024

(30) Foreign Application Priority Data

Nov. 5, 2021 (EP) ..... 21206738

(51) Int. Cl.
*E21F 13/02* (2006.01)
*E02F 3/43* (2006.01)
*E02F 9/20* (2006.01)

(52) U.S. Cl.
CPC ..... *E21F 13/02* (2013.01); *E02F 3/434* (2013.01); *E02F 9/205* (2013.01)

(58) Field of Classification Search
CPC . E21F 13/02; E02F 3/434; E02F 9/205; E02F 9/207; B60Y 2200/41; E21C 27/00; E21C 41/00
See application file for complete search history.

(56) References Cited

U.S. PATENT DOCUMENTS

2008/0234902 A1 9/2008 Johnson et al.
2016/0114783 A1* 4/2016 Young ..... B60W 30/1882 701/22

(Continued)

FOREIGN PATENT DOCUMENTS

EP 1126085 A1 8/2001
EP 3722514 A1 10/2020

(Continued)

OTHER PUBLICATIONS

English translation of Itai et al. (JP 2013231673) (Year: 2013).*

*Primary Examiner* — Kyle J Kingsland
(74) *Attorney, Agent, or Firm* — Corinne R. Gorski

(57) ABSTRACT

A method includes receiving, from an inverter unit of a mining vehicle, driveline information indicative of at least a torque status of an electric motor of the mining vehicle configured to perform an autonomous loading and hauling cycle in a mining automation system, detecting, on the basis of the driveline information from the inverter unit, a phase change condition to change a phase of the autonomous loading and hauling cycle performed by the mining vehicle, from a first phase to a second phase, and controlling, in response to the detected phase change condition, the change of the phase of cycle from the first phase to the second phase.

15 Claims, 3 Drawing Sheets

(56) References Cited

U.S. PATENT DOCUMENTS

| | | | | |
|---|---|---|---|---|
| 2018/0179732 | A1 | 6/2018 | Bartsch et al. | |
| 2021/0148083 | A1 | 5/2021 | Taylor et al. | |
| 2021/0148084 | A1* | 5/2021 | Ashby | E02F 9/2029 |
| 2023/0028338 | A1* | 1/2023 | Samuelsson | G05D 1/0278 |
| 2023/0109143 | A1* | 4/2023 | Vollmar | E02F 9/0891<br>414/697 |

FOREIGN PATENT DOCUMENTS

| | | | | |
|---|---|---|---|---|
| JP | 2013231673 | A * | 11/2013 | G01M 13/021 |
| WO | 2016058625 | A1 | 4/2016 | |

* cited by examiner

AUTONOMOUS MINING VEHICLE CONTROL

RELATED APPLICATION DATA

This application is a § 371 National Stage Application of PCT International Application No. PCT/EP2022/080428 filed Nov. 1, 2022 with priority to EP 21206738.3 filed Nov. 5, 2021.

FIELD

The present invention relates to controlling autonomously operating mining vehicles, and in particular to controlling a mining vehicle performing an autonomous loading and hauling cycle.

BACKGROUND

Mining or construction excavation worksites, such as underground hard rock or soft rock mines, may comprise areas for automated operation of mining vehicles, such as load and/or haul machines and drilling rigs, which may also be referred to as (mine) vehicles. Such vehicles may be an unmanned, for example remotely controlled from a control room, or a manned mine vehicle, such as a vehicle operated by an operator in a cabin of the vehicle. Vehicles may be configured to perform at least some tasks autonomously. An automated mining vehicle operating in an automatic mode may operate independently, without external control at least for some portion(s) of a work task or drive order, but may be taken under external control at certain operation areas or conditions, such as during states of emergencies.

Some mining vehicles, such as loaders or load and haul devices (LHDs), may be used to load and transport excavated material, such as ore, rocks or sand from one place to another, for example after excavation from an underground mine loading position to out of the mine or to a conveyor transport equipment or a sport reserved for unloading the material. A mining vehicle may be controlled to perform an autonomous loading and hauling cycle which may comprise driving the vehicle to a loading site, loading the vehicle, and driving the vehicle from the loading site to an unloading site, for example.

Automatization of a complete loading and hauling cycle is challenging. For example, due to the dynamic and unpredictable nature of bucket-rock interactions, it is very challenging to develop automated bucket filling that would work efficiently at various conditions. A loading controller needs to manage not only the motion of excavation arms, such as boom and bucket positions, but also penetration rate based on motion of loading equipment platform. For example, the forces that act on a bucket as it is actuated to penetrate a rock pile may vary significantly depending on the properties of rock media in the pile, pile geometry, and distribution of particle sizes and geometry. Mining vehicle operation needs to be substantially changed upon certain stages of the autonomous loading and hauling cycle, such as when arriving at the loading site and a bucket of the vehicle entering a pile.

Patent publication EP3207187 discloses a method for controlling automated bucket loading. A bucket control profile is selected from a set of bucket control profiles, the profiles comprising indications for positions of the boom of the mining vehicle as a function of a distance travelled by the mining vehicle with reference to a reference location.

There is a need to further improve controlling a mining vehicle performing an autonomous loading and hauling cycle.

SUMMARY

According to a first aspect, there is provided an apparatus, being configured to or comprising means configured to: receive, from an inverter unit, driveline information indicative of at least torque status of an electric motor of a mining vehicle configured to perform an autonomous loading and hauling cycle in a mining automation system, detect, on the basis of the driveline information from the inverter unit, a phase change condition to change phase of the autonomous loading and hauling cycle performed by the mining vehicle, from a first phase to a second phase, and control, in response to the detected phase change condition, the change of the phase of the autonomous loading and hauling cycle performed by the mining vehicle from the first phase to the second phase.

The means may comprise one or more processors and memory comprising instructions, when executed by the one or more processors, cause the apparatus to perform the method.

According to a second aspect, there is provided a method for controlling an autonomously operating mining vehicle, the method comprising: receiving, from an inverter unit of a mining vehicle, driveline information indicative of at least torque status of an electric motor of the mining vehicle configured to perform an autonomous loading and hauling cycle in a mining automation system, detecting, on the basis of the driveline information from the inverter unit, a phase change condition to change phase of the autonomous loading and hauling cycle performed by the mining vehicle, from a first phase to a second phase, and controlling, in response to the detected phase change condition, the change of the phase of the autonomous loading and hauling cycle performed by the mining vehicle from the first phase to the second phase.

According to a third aspect, there is provided an apparatus comprising at least one processor, at least one memory including computer program code, the at least one memory and the computer program code being configured to, with the at least one processor core, cause the apparatus at least to perform the method or an embodiment of the method.

According to a fourth aspect, there is provided a computer program, a computer program product or (a non-tangible) computer-readable medium comprising computer program code for, when executed in a data processing apparatus, to cause the apparatus to perform the method or an embodiment thereof.

EMBODIMENTS

The presently disclosed embodiments are applicable, in particular, to various mining vehicles used in mining industry, construction sites etc., suitable for loading, transporting and unloading excavated material or other bulk material. Particular examples of such mining vehicles include dumpers and loading equipment or loaders comprising a bucket attached to a boom. The excavated material may, for example, be rocks excavated in a surface or underground operating area. In this context, the term "rock" is to be understood broadly to cover also a boulder, rock material, crust and other relatively hard material.

Figure 1:
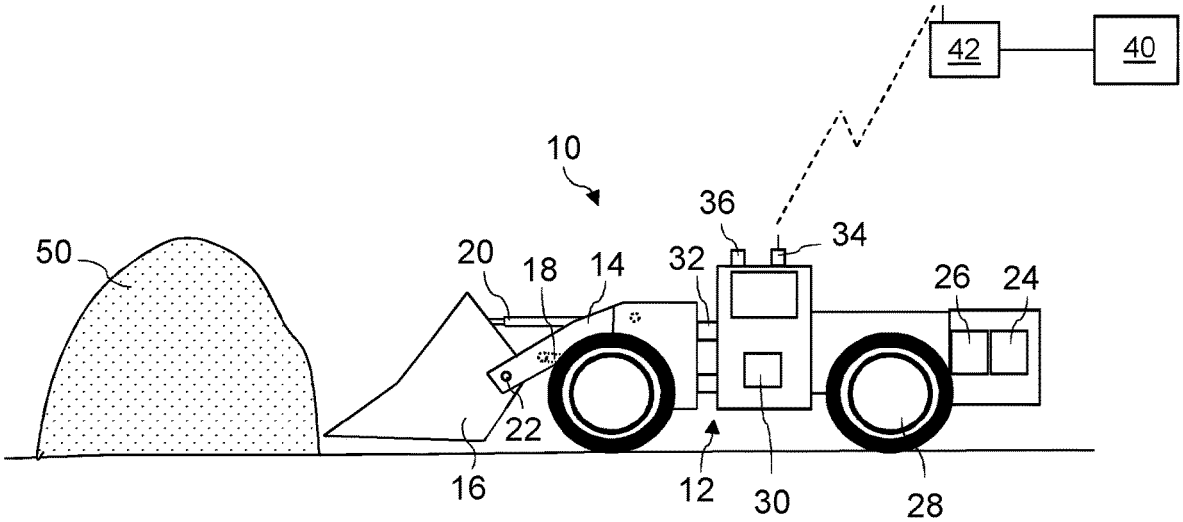
FIG. 1 illustrates an example of a mining vehicle equipped with a bucket.

FIG. 1 shows an example of a mining vehicle 10 comprising a (mobile) carrier 12, one or more booms 14 and a bucket 16 attached in a pivotable or otherwise movable manner to the one or more booms 14. For example, the bucket 16 may be coupled to two booms 14. The attachment may comprise at least one pivot 22, and the bucket 16 may be turned with respect to the pivot(s). The mining vehicle 10 may be an articulated vehicle comprising two sections connected by a joint 32. The mining vehicle may be a load and haul (LHD) vehicle, or a vehicle mainly intended for loading.

The mining vehicle 10 further comprises a first actuator 18 for moving the boom 14 upwards and downwards, and a second actuator 20 for turning the bucket 16 in respect to the pivot 22. The actuators 18, 20 may be hydraulically and/or electrically operable actuators, or operable by some other source of energy. It should also be noted that FIG. 1 is simplified and, for example, the first actuator 18 and/or the second actuator 20 may in practise comprise more than one actuator. For example, a lever arm arrangement may be applied for connecting a cylinder to the bucket 16.

The mining vehicle 10 may comprise a system of pumps 24 for generating hydraulic pressure for operating various parts of the machine, such as lifting the boom 14, turning the bucket, 16 etc. The mining vehicle 10 may comprise one or more other sources of energy, such as an accumulator, a hydrogen container, a fuel tank, etc.

The mining vehicle 10 comprises at least one motor 26, which may be an electric motor. Power from the motor 26 may be provided by a crank shaft (not shown) to front and/or rear wheels 28 either directly or via a gear box (not shown).

The mining vehicle 10 comprises at least one control unit 30. The control unit may comprise one or more processors and memory, configured to control at least some functions and/or actuators of the mining vehicle. In some embodiments, the control unit 30 is configured to control at least autonomous loading and hauling cycle control related operations, and there may be one or more other control units in the mining vehicle for controlling other operations. It is to be appreciated that the control unit 30 may be configured to perform at least some of the below illustrated features, or a plurality of control units or controllers may be applied to perform these features. There may be further operations modules or functions performed by the control unit(s), for example, an automatic bucket loading module, at least one positioning module, autonomous driving control module, and/or an obstacle detection module.

The mining vehicle 10 may be an automated mining vehicle, which in its autonomous operating mode may operate/drive independently without requiring continuous user control. However, the mining vehicle may be taken under external control during states of emergencies, for example.

The mining vehicle 10 may comprise at least one wireless data transfer unit 34, by which the control unit 30 be configured to establish a data transmission connection to another (second) control system 40 external to the mining vehicle 10 by utilising a wireless connection provided by a base station or access node 42. The data transfer unit 34 may thus be connected to a communications system of the worksite, such as a wireless access system comprising a wireless local area network (WLAN) and/or a cellular communications network (for example, a 4G, 5G or another generation cellular network).

The control system 40 may comprise or be connected to a further network(s) and/or data processing system(s), such a worksite management system, a cloud service, a data analytics device/system, an intermediate communications network, such as the internet, etc. The system may comprise or be connected to further device(s) or control unit(s), such as a handheld user unit, a vehicle unit, a worksite management device/system, a remote control and/or monitoring device/system, data analytics device/system, sensor system/device, etc.

A server of the system 40 may be configured to manage at least some operations at the worksite. The server may be configured to provide a user interface for an operator to remotely monitor and, when needed, control automatic operation of the mining vehicles and/or assign work orders for a fleet of vehicles. For example, the server may be configured to instruct a mining vehicle to repeatedly perform an autonomous loading and hauling cycle, and update and/or monitor such work order performance and status. Thus, the mining vehicle 10 may be unmanned, and the user interface may be remote from the mining vehicle. The mining vehicle may be remotely monitored or controlled by an operator in proximity to the mining vehicle, or in control room at the worksite or even long distance away from the worksite via communications network(s).

The mining vehicle 10 may comprise a positioning system or unit. At surface-operated mining vehicles, it may be possible to use satellite-based navigation, such as the GPS system, for determining the location and orientation of the mining vehicle with sufficient accuracy. With underground-operating mining vehicles, instead of satellite based positioning information, positioning based on dead-reckoning and/or scanning tunnel surfaces may be used.

The mining vehicle 10 may comprise one or more scanning units, or scanners 36, configured to perform scanning of the environment of the mining vehicle. In an embodiment, the scanner 36 may be a 2D or 3D scanner, such as a light detection and ranging (LIDAR) device, configured to monitor tunnel walls. The control unit 30 may be configured to compare scanned tunnel profile data to reference profile data stored in an environment model and position the mining vehicle on the basis of finding a match in the environment model. The control unit 30 may be configured to correct positioning by dead-reckoning based on scanning based positioning. In some embodiments, the scanning results are applied to detect position and orientation of the mining vehicle and one or more further elements thereof, such as a position of the scanner 36 or the bucket 16.

A driving plan, or a route plan, may define a route to be driven by the mining vehicle 10 and may be used as an input for automatic control of the mining vehicle. The plan may define a start point, an end point, and a set of route points for the automatic drive. The driving plan may comprise information of a loading area or point and may comprise data for controlling loading of the bucket 16. Automatic loading may be initiated in response to the mining vehicle entering a position or route point of a loading area in the driving plane. The driving plan may be sent via a wired or wireless connection to, or otherwise loaded to the mining vehicle, a memory of the mining vehicle for access by the control unit 30.

When the mining vehicle 10 is performing an autonomous loading and hauling cycle assigned by the control system 40, for example, the mining vehicle may be controlled to drive near a stack or pile 50 of excavated material such as ore, rocks or sand. Detection of clutch slip may be applied as a trigger to detect the mining vehicle to enter a pile or drive at an end stop.

The bucket 16 and also the boom 14 may be lowered down, such that the bucket is on the surface of the ground or near it. The mining vehicle may be driven forward so that the bucket contacts the pile. Bucket loading comprises many stages and actions and it is a difficult task especially for an operator with less experience. If the mining vehicle stops due to too high resistance of the stack of material, the bucket may be lifted upwards, which may enable driving the mining vehicle 10 a bit further, etc.

The bucket loading procedure by the mining vehicle 10 may be automated, for example the machine may autonomously perform a sequence of appropriate movements controlled by the controller unit 30 to fill the bucket 16 and complete the loading by positioning the bucket at a position appropriate for leaving the pile 50 and hauling the load to an unloading location.

There is a need to improve autonomous loading and hauling cycle operations, particularly at cycle change points and to react to changed conditions.

There is now provided an improved autonomous loading and hauling cycle phase change control based on driveline information from an inverter unit, indicative of at least torque status of an electric motor.

Figure 2:
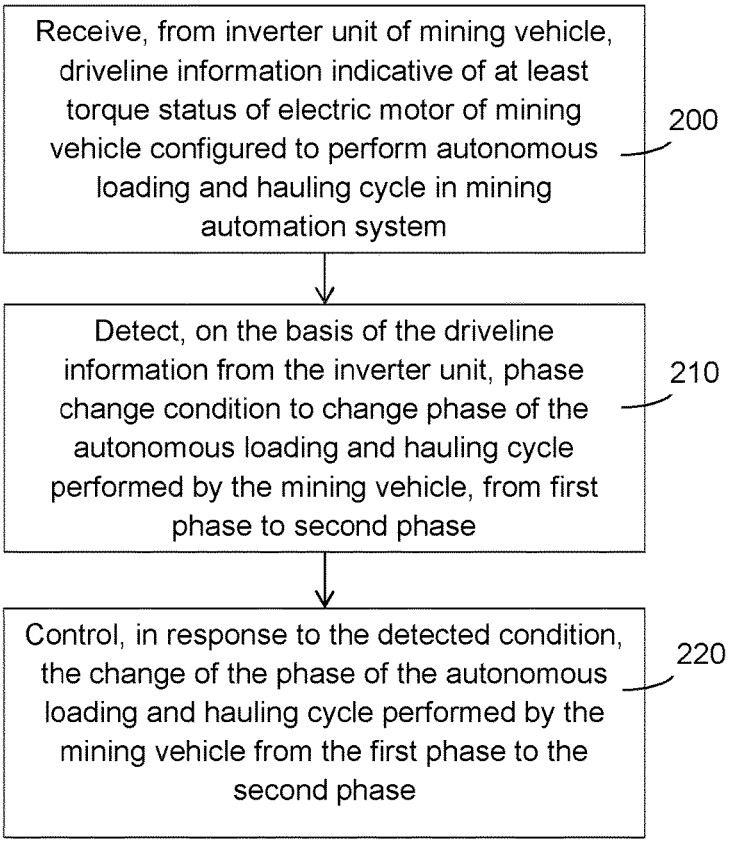
FIG. 2 illustrates a method according to at least some embodiments.

FIG. 2 illustrates a method according to some embodiments. The method may be performed by a mining vehicle and a controlling apparatus thereof, such as the mining vehicle 10, and by the control unit 30 thereof, respectively. The method may be a computer-implemented method.

Block 200 comprises receiving, from an inverter unit of a mining vehicle, driveline information indicative of at least torque status of an electric motor of the mining vehicle configured to perform an autonomous loading and hauling cycle in a mining automation system.

Block 210 comprises detecting, on the basis of the driveline information from the inverter unit, a phase change condition to change phase of the autonomous loading and hauling cycle performed by the mining vehicle, from a first phase to a second phase.

Block 220 comprises controlling, in response to the detected condition, the change of the phase of the autonomous loading and hauling cycle performed by the mining vehicle from the first phase to the second phase.

The autonomous loading and hauling cycle may refer to a procedure, performed by the mining vehicle autonomously, comprising loading the vehicle and driving the mining vehicle to and/or from the loading position. In some embodiments, the mining vehicle is a load and haul device and equipped with a boom and a bucket connected to the boom. It is to be noted that the autonomous operation of the mining vehicle may be monitored by an operator, typically remotely at a monitoring or control site.

The phase of autonomous operation of the mining vehicle may generally refer to an operation phase or stage of an autonomous loading and hauling procedure assigned to the mining vehicle and which may be repeated by the mining vehicle. The procedure/cycle may comprise a sequence of such operation phases or stages, which may be performed in a predefined order.

For example, the autonomous loading and hauling cycle may comprise an autonomous driving phase (from an unloading site to a loading site, for example), a loading phase (or an automatic loading procedure phase), an autonomous driving phase (from the loading site to the loading site), and an unloading phase. One or more of the phases may comprise sub-phases or states which the mining vehicle may be configured to perform during the phase. For example, the loading phase may comprise the following sub-phases: a pile search or approach phase, a pile entering phase, and a bucket loading phase. It is to be noted that the apparatus may be configured to perform the method of FIG. 2 for controlling change between sub-phases, so the term phase herein may in some embodiments refer to a sub-phase, or action, or phase within a cycle (main or upper level) phase.

It will be appreciated that the phases may be defined and named in many other ways. In a further example, pile search and pile contact may be in a single phase, and may instead be referred to as an automatic loading procedure initiation phase.

The torque status may refer generally to information indicative of (or at least dependent of) current level of output torque of the electric motor of the vehicle. Further, it is to be noted that one or more of the phase transitions within the cycle may be detected and triggered based on other input(s) than the torque status. A set of conditions, including a condition for the torque status may be required for the phase change and to enter block 220. For example, such other inputs may comprise one or more of: vehicle (ground) speed, driveline speed, wheel slip indication, mining vehicle position information, obstacle or object recognition (based on camera or scanner data processing, for example), or a vehicle sensor information or detection input. For example, the phase change condition triggering phase transition from the loading phase to the driving phase (to first reverse drive from the pile), may be detected 210 based on a bucket limit sensor signal or bucket pressure information or mining vehicle position information. In some embodiments, the phase change detection in block 210 is based on sensor fusion and the torque status. The torque status may thus be one input and condition being processed when determining whether to change the phase of the autonomous loading and hauling cycle, particularly advantageous for reacting to certain changed conditions.

A phase change control function or module may be configured to continuously check if the phase change condition is met. This may be performed based on a set of input parameters, including the driveline information, and phase change rules, which may comprise or be associated with threshold values. The mining vehicle may thus perform a phase transition in or after block 220. The present features enable faster and more accurate reaction to changing conditions during the autonomous loading and hauling cycle, to detect the need for cycle phase change, thus facilitating to further improve load and haul operations efficiency in varying conditions.

A phase of the autonomous loading and hauling cycle may comprise or cause at least one specific operation mode for the mining vehicle. For example, the mining vehicle 10 may be configured to, in response to a cycle phase change, transition between an autonomous driving mode and a loading mode. The mining vehicle may be configured to transition between two or more operation modes during a phase. For example, the loading phase may comprise or cause an adaptive loading procedure which may comprise a plurality of operation modes or actions.

The driveline information may generally refer to information indicative of status or parameter of a driveline component or system. Driveline components of a mining vehicle may comprise a motor, a gearbox, and a transmission mechanism. Some vehicles may be directly driven systems that do not have a gearbox or a clutch. The driveline information may generally be received from a driveline component or a control system or unit thereof. In some embodiments, the driveline information refers to information defined by an inverter unit of an electric motor. The inverter unit may be configured to provide driveline information indicative of the torque status to a control unit, such as the control unit 30. The driveline information may also be indicative of some other driveline status, such as driveline rotational speed.

The apparatus may be configured to, in response to entering the second phase based on block 220, control position of the boom 14, position of the bucket 16, and/or speed of the mining vehicle 10 on the basis of a set of control parameters defined for the second phase of the autonomous loading and hauling cycle.

Figure 3:
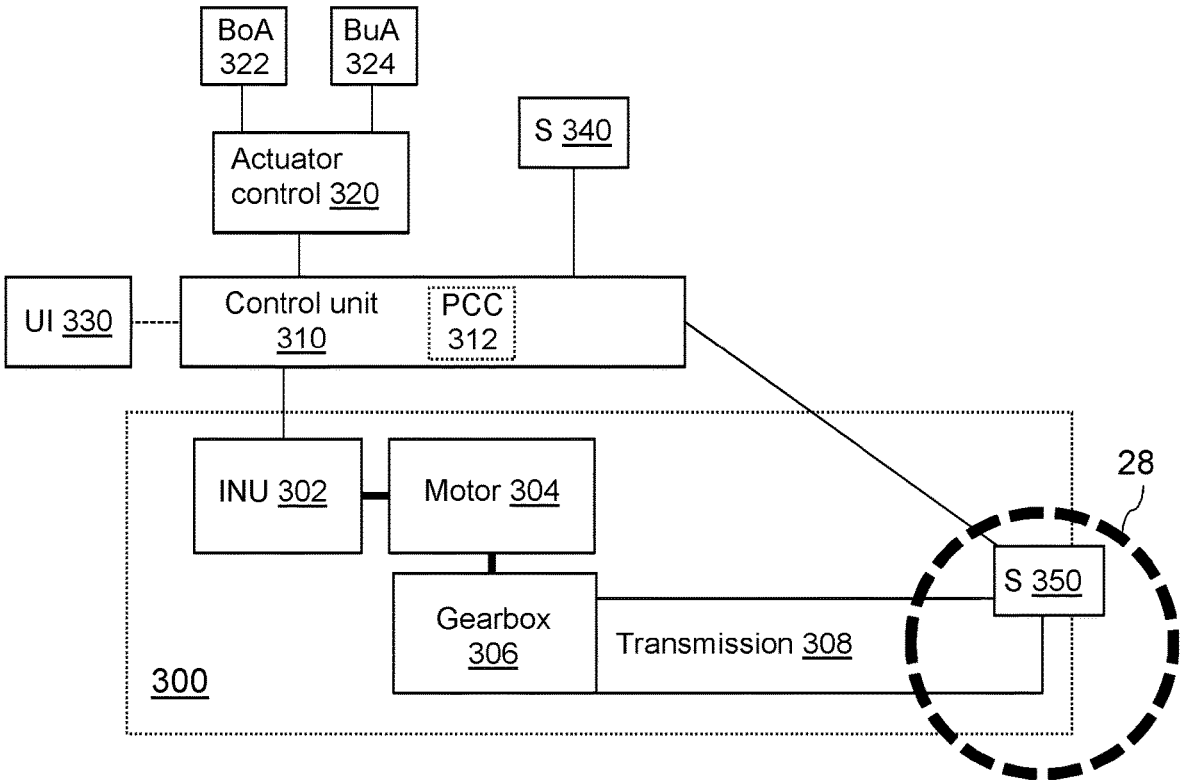
FIG. 3 illustrates an arrangement for controlling autonomous loading and hauling cycle by a mining vehicle.

FIG. 3 illustrates an arrangement and elements of a mining vehicle, such as the mining vehicle 10, configured to perform the autonomous loading and hauling cycle, the method of FIG. 2, and at least some embodiments thereof. In this example, driveline 300 of the mining vehicle comprises an electric motor 304 driven by an inverter unit (INU) 302. The INU 302 comprises an inverter, which at least in some instances may also be referred to as frequency converter, alternative current (AC) drive, variable speed drive (VSD), or variable frequency drives (VFD), controlling the voltage and frequency of power supplied to an AC motor to control the torque and rotation speed of the motor 304.

Wheels 28, such as front wheels and rear wheels of the mining vehicle 10 are rotated by a transmission mechanism 308. The transmission mechanism 308 is rotated by a gear box (or drop) assembly 306. The gear box is driven by the electric motor 304. The INU 302 is powered by electric energy from an electrical supply of the mining vehicle (not shown).

A control system or unit 310, such as the control unit 30, may be the apparatus configured to perform the method of FIG. 2 and receive (200) information from the driveline 300. The control unit 310 may be configured to perform a phase change control (PCC) function or routine 312 performing the method and at least some embodiments of the method. The control unit 310 may comprise one or more computing units/processors executing computer program code stored in memory. The control unit may be connected to one or more other control units of a control system of the mining vehicle, in some embodiments by a controller area network (CAN) bus. The control unit 310 may be configured to receive 200 the driveline information from the bus system (provided to the bus by the INU 302), or directly from the INU 302. The INU 302 may be configured to define the torque status (as output torque) computationally by processing voltage and current output from the inverter to the motor. However, it is to be appreciated that there are a number of options to arrange definition of the current torque by the inverter unit, which may apply sensor(s), such as rotor speed sensor.

The control unit 310 may be configured to transmit control signals in accordance with currently performed autonomous loading and hauling cycle phase (and associated set of control parameters) to the INU 302 to control the driveline rotational speed and/or torque. The control unit 310 may be configured to control the INU 302, in response to entering block 220, on the basis of parameter(s) associated with the second phase to control the motor 304 of the mining vehicle.

The control unit 310 may in some embodiments be directly or indirectly connected also to further elements of the driveline, such as the motor 304 or a further controller thereof, or a sensor in the driveline. For example, the RPM (revolutions per minute) of the front wheel(s) can be measured by RPM sensor(s). The control unit 310 may be configured to obtain the RPM information from the driveline and process it by an algorithm to detect slippage or spin of the wheels. The algorithm may be configured to maintain the RPM within a predetermined range. The driveline RPM can be readily obtained and the wheel RPM calculated therefrom.

The control unit 310 may be connected to an actuator control unit or (sub) system 320, which may be connected to boom actuator (BoA) 322 and bucket actuator (BuA) 324. In block 220, the control unit 310 may transmit control signals on the basis of (or comprising) control parameters according to the second phase to the actuator control system 320, which controls the BoA 322 and BuA 324 to accordingly control the boom 14 and the bucket 16. It is to be noted that the boom and the bucket may have separate actuator controls, which may be directly connected to the control unit 310. An actuator control (sub) system may comprise or be connected to hydraulic circuits having lift and tilt actuator control valves for controlling the rate at which pressurized hydraulic fluid flows to respective lift and tilt hydraulic actuators in proportion to control signals.

A user interface (UI) 330 may be connected to the control unit 310, locally at the mining vehicle or via communications unit(s). The UI may comprise, for example, a joystick, a touch screen, or other input means by which an input signal from a user may be provided to the control unit for controlling the autonomous loading and hauling cycle.

The control unit 310 may be connected to further units in the mining vehicle, such as further sensors or sensor systems 340 and 350 configured to provide inputs for the control unit 310. Examples of such sensors include boom or bucket limit sensors, boom or bucket position detection sensors, hydraulic pressure sensors, and bucket pressure measurement sensors. The sensor 350 may be a wheel rotation sensor.

The mining vehicle 10 of FIG. 1 and the system of FIG. 3 are disclosed herein only as examples where the embodiments disclosed herein may be implemented. For example, the vehicle may comprise a directly driven system and lack the gearbox 306. The embodiments are applicable to various other types and configurations of mining vehicles and control units. Below some further example embodiments are illustrated, at least some of which may be performed by the control unit 30, 310 as the performing apparatus, for example.

Block 210 may comprise detecting the torque status to meet a threshold value. The threshold value may be preconfigured in the apparatus to trigger the status change. For example, a first threshold value may be set to detect the mining vehicle to enter a pile, which may trigger the mining vehicle to enter bucket loading phase. A second threshold value may be set to detect the mining vehicle to enter a drive stop element, which may trigger the mining vehicle to enter (bucket) unloading phase. The apparatus may be configured with torque reference data used for detecting the phase change condition. The torque reference data may define one or more threshold values. For example, the torque reference data may indicate a range of allowable values for a torque status, and the deviation of the torque status from the range causes detecting 210 the phase change condition. The torque reference data may be preconfigured and/or adapted during performing the autonomous loading and hauling cycle.

The threshold value may be indicative of an absolute or relative change. For example, the threshold value may define a phase change trigger condition, which is met upon the torque level increasing or reducing from a reference torque level value by a predetermined amount or percentage. For example, the threshold value may be a maximum level, medium level, or a predefined (target) level. In an example, a threshold value may cause detecting 210 the phase change condition upon the torque level being 85% or less of maximum detected torque level.

The apparatus may be configured to apply one or more temporal parameters affecting the detecting 210 the phase change condition. For example, block 210 may apply a time parameter indicative of a time period for past torque values, to exclude old torque values that are not within the time period. In another example embodiment, detecting the phase change condition may comprise detecting the torque status to change by at least a predetermined absolute or relative (threshold) amount within a predetermined time period. The torque status received in block 200 may be compared to past torque value(s) of the presently performed phase (and torque values in the preceding phase are excluded). For example, for pile detection and phase change to bucket loading, the phase change condition may require that the torque status has increased by at least a predetermined threshold value, such as 25%, from a highest torque value detected during currently performed phase (such as pile approach phase).

In addition to applying the torque status and the torque status requiring the phase change, further inputs may be processed and one or more further rules or pre-requisites may be required in order to detect 210 the phase change condition and to enter block 220. Thus, there may be further block(s) of receiving further input(s), processing the input (s), and entering to block 220 in response to an associate rule or necessitating the phase change. For example, one or more threshold values may need to be met in order to enter block 220. Examples of such threshold values include a driveline information threshold value, a wheel slip condition or associated threshold value(s), and/or a temporal threshold value. Examples of driveline information threshold value include at least one threshold value on driveline or motor rotational speed or RPM and/or a threshold value on power.

In some embodiments, the apparatus is configured to apply wheel slip condition information indicative of wheel slip as a further input for detecting 210 the phase change condition. In an example embodiment, sensors 350 are arranged at right and left front wheels 28 for determining speed of the front wheels. The control unit 310 may be configured to determine speed difference of the front wheels based on signals from the sensors and detect the slip condition in response to the speed difference exceeding a traction control threshold value preconfigured for the loading procedure. Thus, a parameter set with reduced traction may be entered, enabling to reduce tyre wear.

In some embodiments, the mining vehicle 10 comprises at least two electric motors. Thus, the driveline information may comprise at least two torque status inputs, and at least one memory and the computer program code are configured to, with the at least one processor, cause the apparatus to detect the status change condition in response to at least one of the torque status inputs meeting a phase change trigger condition.

The mining vehicle 10 may comprise a plurality of INUs, for example, one for each motor, and the control unit 310 may be configured to receive the driveline information from the INUs. For example, there may be an INU for a motor coupled to rear axle transmission mechanism and another INU for a motor coupled to front axle transmission mechanism. The torque status inputs may have different threshold parameters or they may be independently or differently processed or weighted. In a simple example, the control unit 310 is configured to apply a threshold value (to detect 210 the phase change condition) for a rear axle torque status input different from a threshold value for a front axle torque status input. In a further example embodiment, a threshold status of all torque status inputs, such as torque status of all axles, needs to meet a preconfigured threshold level (which may be different for different inputs). In a still further example embodiment, the control unit may be configured to define difference between torque status inputs and detect the change condition in response to the difference meeting a preconfigured threshold value.

In some embodiments, the first phase and the second phase are consecutive phases or stages of an adaptive bucket loading procedure. The procedure may be performed as part of the autonomous loading and hauling cycle. A phase of the adaptive bucket loading procedure and associated control parameter set may be selected and entered to react to a detected phase change condition based on the driveline information.

In some embodiments, the automatic adaptive loading procedure is associated with a set of control profiles to control position of the bucket (16) of the mining vehicle and/or the boom (14) of the mining vehicle. The change to the second phase may comprise or cause performing a control profile selected from the set of control profiles. The control profile may be indicative of position(s) of the boom and/or the bucket in relation to distance travelled by the mining vehicle. The apparatus may be configured to select the control profile based on the driveline information. The apparatus may be configured to, during the bucket loading phase, define based on the driveline information if the control profile needs to be changed. Upon detecting the need, the control profile and associated control parameters are changed.

The control profile may comprise information on at least one desired or target position of the bucket 16 and/or the boom 14 of the vehicle 10 as a function of distance with reference to a reference location. There may be one or more control profiles common for both the bucket and the boom, or there may be separate control profiles, which may thus be called as a bucket control profile and a boom control profile, respectively. A set of control profiles includes several control profiles, wherein one of the control profiles in the set may also be called as a basic (or default or main) control profile. The control profiles may be location-specific control profiles, such as loading site specific location profiles. In some embodiments, the apparatus may be configured to apply control profiles, and at least some of the associated functionality to change the profile during the bucket loading, as further described in EP3207187.

The control profile may comprise torque reference data. The apparatus may be configured to detect 210 the phase change condition on the basis of the torque reference data. For example, the torque reference data may indicate a range of allowable values for a torque status for the control profile, and the deviation of the current torque status from the range causes the phase change (and may cause a profile change).

When sets of control parameters are preconfigured in a memory of the mining vehicle 10, such as memory accessible by the control unit 30, the apparatus may be configured to select a set of control parameters after block 220 among stored sets of control parameters based on the received driveline information. The apparatus may also be configured to dynamically generate some or all of the values in the parameter set, based on preconfigured control logic.

Temporal relationship between at least some of the plurality of control parameters in the set may be defined, and the apparatus may be configured to apply these parameters in block 220 according to the temporal relationship. Such temporal relationship information, such as timing information for parameters in the set, may be stored as part of the parameter set. The set of control parameters may be a sequence of control parameters. Timing of at least some of the parameters may be defined in the set. The timing may be defined in relation to one or more other parameters of the set or another reference, such as start of block 220.

A control parameter in the set may define a target value for a controlled entity, and control action may be initiated in block 220 to approach the target value. The set of parameters may comprise a plurality of subsequent values for given parameter(s). For example, there may be a plurality of different speed and/or torque values to be applied in the set. Different values may have different durations, for example time periods during which they are applied. There may be another criterion than time elapsed or time threshold for changing the value, some further examples being illustrated below.

The apparatus may be configured to define, on the basis of the driveline information and one or more threshold conditions, if redefinition or change of applied set of control parameters and/or a phase of the procedure or the cycle is to be triggered. This may be an additional block continued during or after block 220 and repeated during the adaptive loading procedure.

The apparatus may be configured to determine, during the automatic adaptive loading procedure, if a change condition for changing the set of control parameters, a parameter in the defined set of control parameters, or an automatic adaptive loading procedure phase or action is met. In an example embodiment, a need to adapt one or more parameters in the defined set is detected and the one or more parameters may be dynamically adapted during application of the set. The change condition to change the parameter set may be detected in response to block 210, but may also be detected when the cycle phase is not changing. In response to the change condition being met, the set of control parameters, a parameter in the defined set, or the action (re) defined and changed.

The apparatus may be configured to monitor duration of the phase, and/or duration of applying the defined or selected set of control profile or control parameters for the second phase. The apparatus may be configured to control change of the control profile or the set of control parameters to control position of the boom, position of the bucket, and/or speed of the mining vehicle in response to a period of time of applying the defined set exceeding a threshold value. This enables to ensure that a given profile or parameter set (and associated automatic loading action) is not applied unnecessarily long during the loading procedure. In an example embodiment, a parameter in the set is applied for a predefined period of time, which may be identified by the set. Thus, some parameters of the set may be applied only for part of the loading action and application time of the parameter set.

Figure 4:
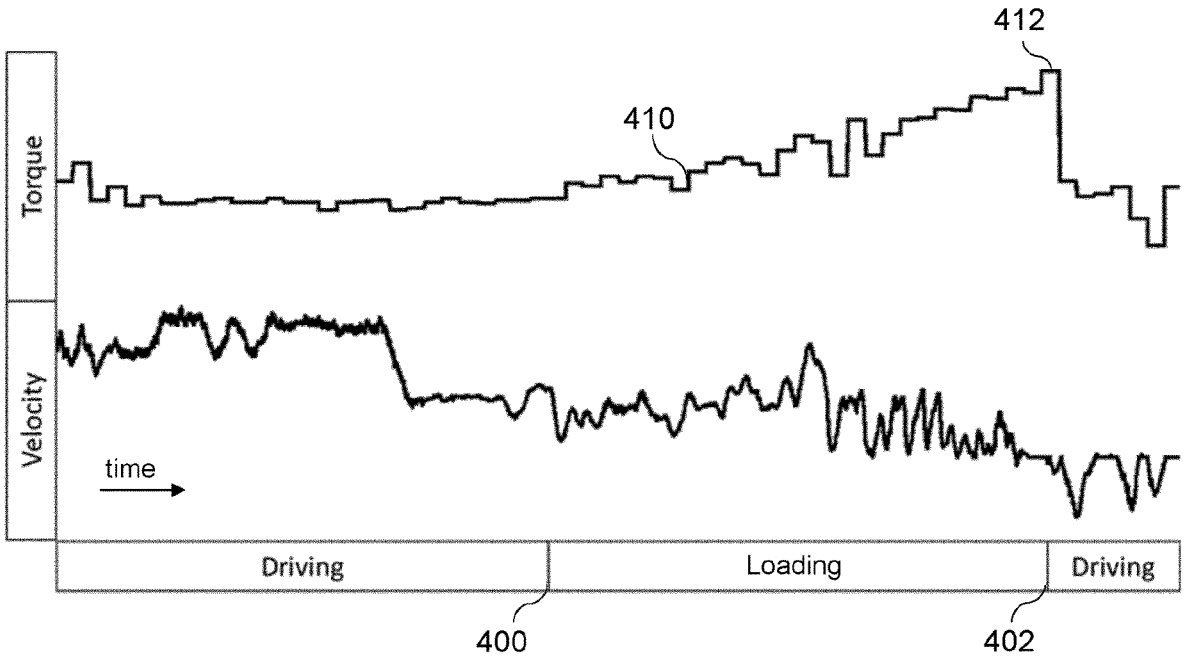
FIG. 4 illustrates an example of driveline parameter levels during an autonomous loading and hauling cycle.

FIG. 4 illustrates an example of a portion of an example autonomous loading and hauling cycle. Upper descriptor is indicative of torque status over time and different cycle phases and the lower descriptor is indicative of velocity, such as ground speed, of the mining vehicle over time and different cycle phases. At time instant 400, the general cycle phase is changed from driving to loading (of bucket). This status change may be triggered based on another input than the torque status, such as current mining vehicle position and detecting the mining vehicle to enter loading area, or an input from the control system 40 (for example, based on the control system detecting the mining vehicle to enter the loading site or an operator input). At time instant 402 the cycle phase is changed from loading to driving phase (to reverse the vehicle from the pile). At time instant 412, the torque status is, or has been for a predetermined time, at a level causing a phase change to the driving phase. For example, as sub-phases or states, the loading phase may comprise searching for pile, pile contact, filling of bucket, and the driving phase after 412 may comprise reversing from the pile. For example, at time instant 410, pile contact may be detected and bucket filling sub-phase or state entered (which may cause performing at least one control profile for controlling the bucket 16 and/or the boom 14).

The apparatus, such as the control unit 30, 310, may be configured to detect predefined condition(s), such as environment condition(s), based on the driveline information from the INU 302. For example, the apparatus may be configured to detect the mining vehicle driving downhill or uphill, and adapt driveline control accordingly. In an example embodiment, the apparatus is configured to perform a route or road cleaning phase or mode, during which the mining vehicle drives with the bucket on the ground and collects excess material, such as loose rocks. The apparatus may be configured to monitor torque status during road cleaning phase or mode and detect excess resistance based on the torque status. If the torque status exceeds a threshold value, the apparatus may control raising of the bucket 16.

It is to be appreciated that various further features may be complement or differentiate at least some of the above-illustrated embodiments. For example, there may be further user interaction and/or automation functionality further facilitating the operator to monitor the mining vehicle during the autonomous loading and hauling cycle, input appropriate action via the UI 330 to overcome an issue detected during the procedure, for example by selecting a control parameter set to overcome the issue.

An electronic device comprising electronic circuitries may be an apparatus for realizing at least some embodiments illustrated above, such as the method illustrated in connection with FIG. 2 and features illustrated for the control unit 30, 310. The apparatus may be comprised in at least one computing device connected to or integrated into a control system of the mining vehicle. Such control system may be an intelligent on-board control system controlling operation of various sub-systems of the mining vehicle, such as a hydraulic system, a motor, etc, in one example the sub-systems illustrated in FIG. 3. Such control systems are often distributed and include many independent modules connected by a bus system of controller area network (CAN) nodes, for example.

Figure 5:
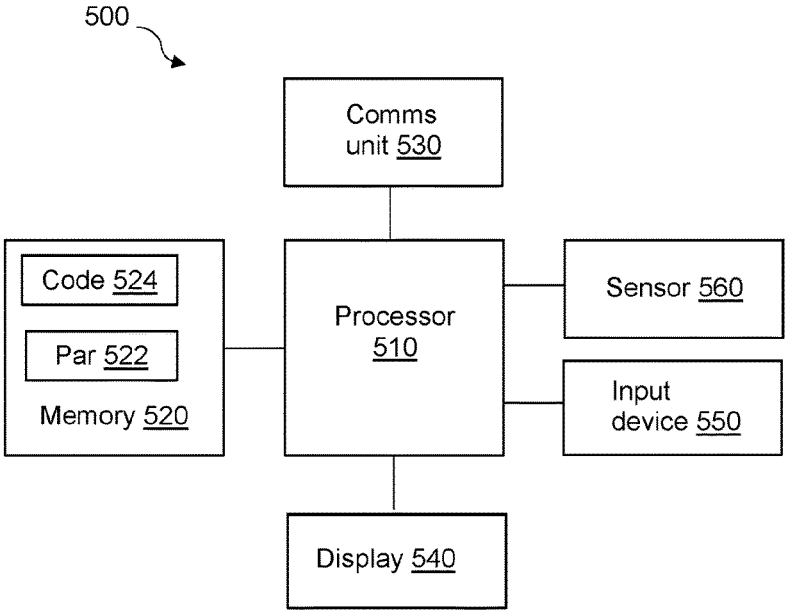
FIG. 5 illustrates an example apparatus capable of supporting at least some embodiments.

FIG. 5 illustrates a simplified example apparatus capable of supporting at least some embodiments of the present invention. Illustrated is a device 500, which may be configured to carry out at least some of the embodiments relating to controlling the phase change in an autonomous loading and hauling cycle as illustrated above. In some embodiments, the device 500 comprises or implements the control unit 30 or 310, or other module(s), functions and/or unit(s) for performing at least some of the above-illustrated embodiments.

Comprised in the device 500 is a processor 510, which may comprise, for example, a single- or multi-core processor. The processor 510 may comprise more than one processor. The processor may comprise at least one application-specific integrated circuit, ASIC. The processor may comprise at least one field-programmable gate array, FPGA. The processor may be configured, at least in part by computer instructions, to perform actions.

The device 500 may comprise memory 520. The memory may comprise random-access memory and/or permanent memory. The memory may be at least in part accessible to the processor 510. The memory may be at least in part comprised in the processor 510. The memory may be at least in part external to the device 500 but accessible to the device. The memory 520 may be means for storing information, such as parameters 522 affecting operations of the device. The parameter information in particular may comprise parameter information affecting the phase change control related features, such as threshold values.

The memory 520 may be a non-transitory computer readable medium comprising computer program code 524 including computer instructions that the processor 510 is configured to execute. When computer instructions configured to cause the processor to perform certain actions are stored in the memory, and the device in overall is configured to run under the direction of the processor using computer instructions from the memory, the processor and/or its at least one processing core may be considered to be configured to perform said certain actions. The processor may, together with the memory and computer program code, form means for performing at least some of the above-illustrated method steps in the device.

The device 500 may comprise a communications unit 530 comprising a transmitter and/or a receiver. The transmitter and the receiver may be configured to transmit and receive, respectively, for example data and control commands within or outside the mining vehicle. The transmitter and/or receiver may be configured to operate in accordance with wideband code division multiple access, WCDMA, long term evolution, LTE, 3GPP new radio access technology (N-RAT), wireless local area network, WLAN, and/or Ethernet standards, for example.

The device 500 may comprise or be connected to a UI. The UI may comprise at least one of a display 540, a speaker, an input device 550 such as a keyboard, a joystick, a touchscreen, and/or a microphone. The UI may be configured to display views on the basis of above illustrated embodiments. A user may operate the device and control at least some of above illustrated features. In some embodiments, the user may control the mining vehicle 10 via the UI, for example to manually drive the vehicle, operate a boom, initiate automatic loading, change mode, change parameter set, change display views, modify parameters 522, etc.

The device 500 may further comprise and/or be connected to further units, devices and systems, such as one or more sensor devices 560 configured to detect environment of the device 500 or properties of the mining vehicle, such as wheel rotation or hydraulic pressure.

The processor 510, the memory 520, the communications unit 530 and the UI may be interconnected by electrical leads internal to the device 500 in a multitude of different ways. For example, each of the aforementioned devices may be separately connected to a master bus internal to the device, to allow for the devices to exchange information. However, as the skilled person will appreciate, this is only one example and depending on the embodiment various ways of interconnecting at least two of the aforementioned devices may be selected without departing from the scope of the present invention.

The apparatus, such as the device 500, may be configured to: receive, from an inverter unit, driveline information indicative of at least torque status of an electric motor of a mining vehicle configured to perform an autonomous loading and hauling cycle in a mining automation system, detect, on the basis of the driveline information from the inverter unit, a phase change condition to change phase of the autonomous loading and hauling cycle performed by the mining vehicle, from a first phase to a second phase, and control, in response to the detected phase change condition, the change of the phase of the autonomous loading and hauling cycle performed by the mining vehicle from the first phase to the second phase. The first phase and the second phase may comprise an autonomous driving phase and an automatic loading phase, for example.

The apparatus may be configured to, in response to entering the second phase, control position of a boom of the mining vehicle, position of a bucket of the mining vehicle, and/or speed of the mining vehicle on the basis of a set of control parameters defined for the second phase of the autonomous loading and hauling cycle.

The first phase and the second phase may be phases of an automatic adaptive loading procedure of or associated with the cycle. The automatic adaptive loading procedure may be associated with a set of control profiles to control position of the bucket (16) of the mining vehicle and/or the boom of the mining vehicle. The change to the second phase may cause performing a control profile selected from the set of control profiles.

The apparatus may be configured to select the control profile based on the driveline information. The control profile may comprise torque reference data. The phase change condition may be detected on the basis of the torque reference data.

The apparatus may be configured to detect the phase change condition by detecting the torque status to meet a threshold value. For example, a first threshold value may be set to detect the mining vehicle to enter or approach a pile, and a second threshold value may be set to detect the mining vehicle to enter a drive stop element.

The driveline information from the inverter unit may be indicative of driveline rotational speed and the torque status.

The mining vehicle may comprise at least two electric motors, and the driveline information may comprise at least two torque status inputs. The apparatus may be configured to detect the status change condition in response to at least one of the torque status inputs meeting a phase change trigger condition.

The apparatus may be configured to detect the change condition further based on a wheel slip condition and/or a temporal threshold value.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to one embodiment or an embodiment means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment. Where reference is made to a numerical value using a term such as, for example, about or substantially, the exact numerical value is also disclosed.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the preceding description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", that is, a singular form, throughout this document does not exclude a plurality.

The invention claimed is:

1. An apparatus for controlling a mining vehicle configured to perform an autonomous loading and hauling cycle including a sequence of operation phases performed in a predefined order in a mining automation system, the apparatus comprising at least one processor and at least one memory including computer program code, the at least one memory and the computer program code being configured to, with the at least one processor, cause the apparatus at least to:

receive, from an inverter unit of the mining vehicle, driveline information indicative of at least a torque status of an electric motor of the mining vehicle;

detect, on the basis of the driveline information from the inverter unit, a phase change condition to change phase of the autonomous loading and hauling cycle performed by the mining vehicle, from a first phase of the autonomous loading and hauling cycle to a second phase of the autonomous loading and hauling cycle; and control, in response to the detected phase change condition, the change of the phase of the autonomous loading and hauling cycle performed by the mining vehicle from the first phase of the autonomous loading and hauling cycle to the second phase of the autonomous loading and hauling cycle.

2. The apparatus of claim 1, wherein the first phase and the second phase comprise an autonomous driving phase and an automatic loading phase.

3. The apparatus of claim 1, wherein the at least one memory and the computer program code are configured to, with the at least one processor, cause the apparatus to, in response to entering the second phase, control a position of a boom of the mining vehicle, a position of a bucket of the mining vehicle, and/or speed of the mining vehicle on a basis of a set of control parameters defined for the second phase of the autonomous loading and hauling cycle.

4. The apparatus of claim 1, wherein the first phase and the second phase are phases of an automatic adaptive loading procedure of or associated with the cycle, the automatic adaptive loading procedure being associated with a set of control profiles to control position of the bucket of the mining vehicle and/or the boom of the mining vehicle, and the change to the second phase causes performing a control profile selected from the set of control profiles.

5. The apparatus of claim 4, wherein the at least one memory and the computer program code are configured to, with the at least one processor, cause the apparatus to select the control profile based on the driveline information.

6. The apparatus of claim 4, wherein the control profile includes torque reference data, and the phase change condition is detected on the basis of the torque reference data.

7. The apparatus of claim 1, wherein detecting of the phase change condition includes detecting the torque status to meet a threshold value, wherein a first threshold value is set to detect the mining vehicle to enter or approach a pile and a second threshold value is set to detect the mining vehicle to enter a drive stop element.

8. The apparatus of claim 1, wherein the driveline information from the inverter unit is indicative of driveline rotational speed and the torque status.

9. The apparatus of claim 1, wherein the mining vehicle includes at least two electric motors, the driveline information includes at least two torque status inputs, and at least one memory and the computer program code are configured to, with the at least one processor, cause the apparatus to detect the status change condition in response to at least one of the torque status inputs meeting a phase change trigger condition.

10. The apparatus of claim 1, wherein the detecting of the change condition further includes detecting a wheel slip condition and/or a temporal threshold value.

11. A mining vehicle, comprising the apparatus of claim 1.

12. A method for controlling a mining vehicle configured to perform an autonomous loading and hauling cycle including a sequence of operation phases performed in a predefined order in a mining automation system, the method comprising:

receiving, from an inverter unit of the mining vehicle, driveline information indicative of at least a torque status of an electric motor of the mining vehicle;

detecting, on the basis of the driveline information from the inverter unit, a phase change condition to change a phase of the autonomous loading and hauling cycle performed by the mining vehicle, from a first phase of the autonomous loading and hauling cycle to a second phase of the autonomous loading and hauling cycle; and controlling, in response to the detected phase change condition, the change of the phase of the autonomous loading and hauling cycle performed by the mining vehicle from the first phase of the autonomous loading and hauling cycle to the second phase of the autonomous loading and hauling cycle.

13. The method of claim 12, further comprising controlling, in response to entering the second phase, a position of a boom of the mining vehicle, a position of a bucket of the mining vehicle, and/or speed of the mining vehicle on a basis of a set of control parameters defined for the second phase of the autonomous loading and hauling cycle.

14. The method of claim 12, wherein the first phase and the second phase are phases of an automatic adaptive loading procedure of or associated with the cycle, the automatic adaptive loading procedure is associated with a set of control profiles to control position of the bucket of the mining vehicle and/or the boom of the mining vehicle, and the change to the second phase causes performing a control profile selected from the set of control profiles.

15. A non-transitory computer readable medium comprising program code for, when executed in a data processing apparatus, causes the method in accordance with claim 12 to be performed.

* * * * *